US005423134A

United States Patent [19]

Bagnaia et al.

[11] Patent Number: 5,423,134

[45] Date of Patent: Jun. 13, 1995

[54] SANDAL CONSISTING OF COMPONENTS ASSEMBLED WITHOUT THE USE OF SPECIAL TOOLING OR SKILLED LABOUR

[75] Inventors: Luigi Bagnaia, Morbio Inferiore-Ticino, Switzerland; Enrico Capriotti, Como, Italy

[73] Assignee: Lubax L. B. Company S.A., Switzerland

[21] Appl. No.: 226,477

[22] Filed: Apr. 12, 1994

[30] Foreign Application Priority Data

May 6, 1993 [IT] Italy ..... AN93A0027

[51] Int. Cl.[6] ..... A43B 3/12

[52] U.S. Cl. ..... 36/11.5; 36/101

[58] Field of Search ..... 36/11.5, 50.1, 7.5, 36/100, 101, 7.6

[56] References Cited

U.S. PATENT DOCUMENTS

| | | | |
|---|---|---|---|
| 2,469,708 | 5/1949 | Alexander | 36/11.5 |
| 3,516,181 | 6/1970 | Jordan | 36/11.5 |
| 3,902,259 | 9/1975 | Cracco | 36/11.5 |
| 4,124,946 | 11/1978 | Tomlin | 36/11.5 |
| 4,297,798 | 11/1981 | Colan | 36/101 |
| 4,369,537 | 1/1983 | Midgley | 36/11.5 |
| 4,450,633 | 5/1984 | Connelly | 36/101 |
| 4,535,554 | 8/1985 | Deobaldia | 36/11.5 |
| 4,793,075 | 12/1988 | Thatcher | 36/11.5 |
| 4,813,162 | 3/1989 | Harris | 36/11.5 |
| 4,887,369 | 12/1989 | Bailey et al. | 36/101 |

FOREIGN PATENT DOCUMENTS

| | | | |
|---|---|---|---|
| 2633161 | 12/1989 | France | 36/101 |
| 594034 | 10/1947 | United Kingdom | 36/101 |
| 2159038 | 11/1985 | United Kingdom | 36/101 |

*Primary Examiner*—Steven N. Meyers
*Attorney, Agent, or Firm*—Leonard Bloom

[57] ABSTRACT

This invention concerns a sandal consisting of components assembled without the use of special tooling or skilled labor. The sandal according to the invention consists of a moulded plastic sole on which a moulded midsole is attached and press fitted, said midsole having cuts and projections which couple respectively with the corresponding cuts and projections on the underlying sole.

2 Claims, 4 Drawing Sheets

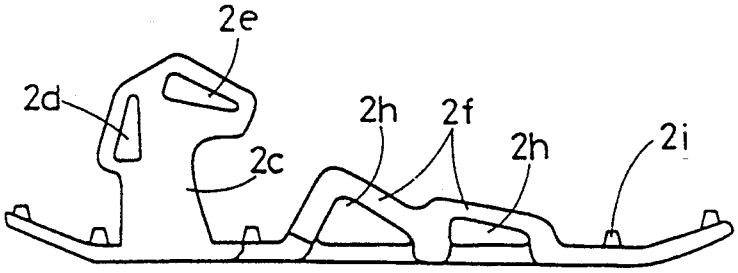
FIG. 6
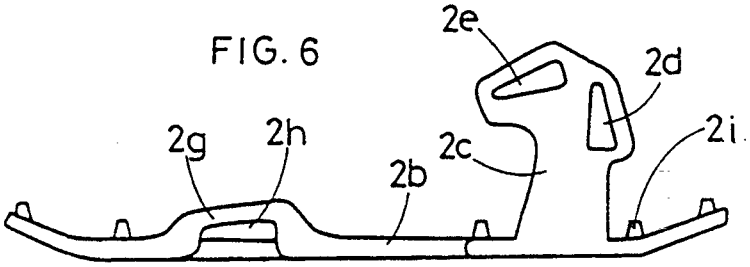
FIG. 7
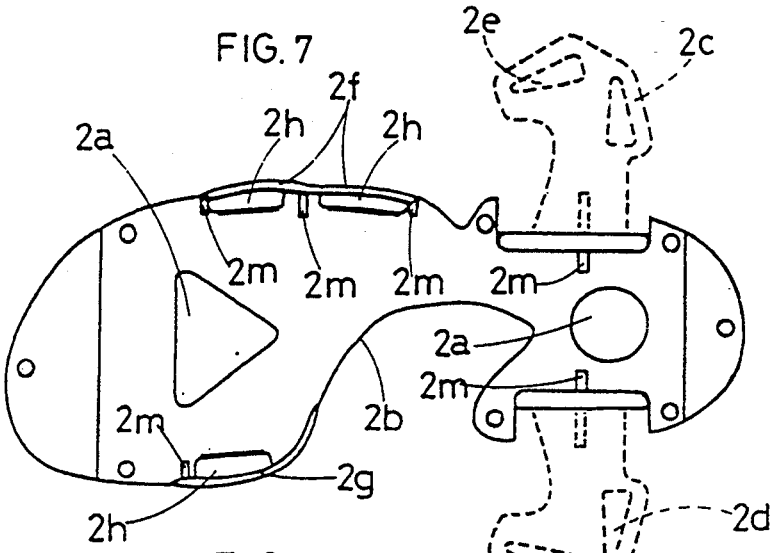
FIG. 4
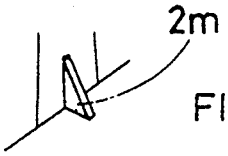
FIG. 4A
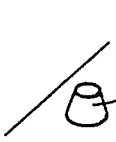
FIG. 4B
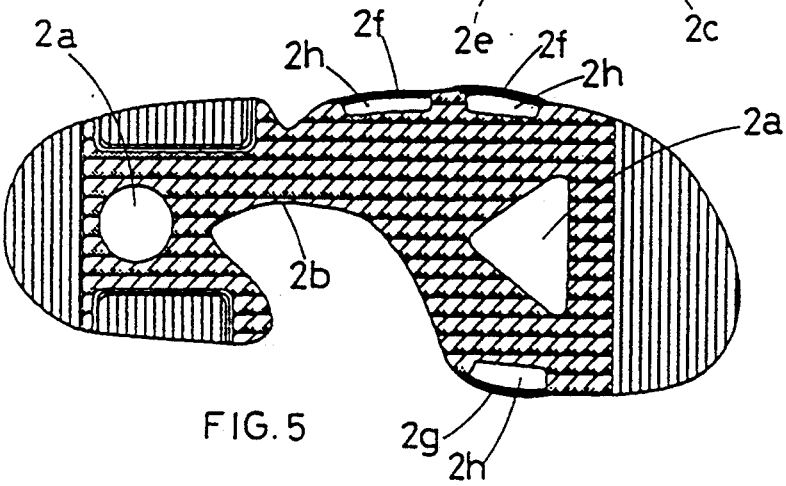
FIG. 5
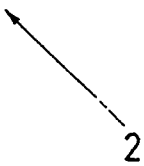

SANDAL CONSISTING OF COMPONENTS ASSEMBLED WITHOUT THE USE OF SPECIAL TOOLING OR SKILLED LABOUR

BACKGROUND OF THE INVENTION

This application concerns a sandal consisting of components assembled without the use of special tooling or skilled labour which can be sold knocked-down in kits, providing the end user with the satisfaction of mounting the sandal personally.

SUMMARY OF THE INVENTION

The sandal according to the invention consists of a moulded plastic sole on which a moulded plastic mid-sole is attached and press fitted, said mid-sole having projections and cuts which couple respectively with the corresponding cuts and projections on the underlying sole.

The opposing sides of the sole edge have shaped projecting flaps with one or more slots for the passage of the straps which form the upper consisting of bands which hold the foot at the ankle and metatarsal area of the foot. Said straps may be made of fabric, leather, synthetic fabric or imitation leather or in any other suitable material. Each strap may be fitted with a standard fastener to ensure its rapid fastening and unfastening, such as a buckle, clips or inserts in self-adhesive material commonly known as "rip-off straps", which permit fixing the end section of the strap prior to folding it back.

A moulded plastic insole is fitted over the mid-sole, the surface of said insole being characterized by a close-fitting series of non-slip projections while the treading surface of the sole being characterized by a non-slip engraved tread.

In the preferred embodiment of the sandal according to the invention, the sandal components (sole, mid-sole, insole and upper) are in different colours so as to create an attractive multicoloured effect.

One of the most important advantages of the sandal according to the invention is the possibility it offers of meeting the different requirements of customers promptly without having to stock large quantities of finished products in the complete range of colour combinations in the collection.

In other words, the footwear shop, by holding an adequate stock of the single components in the different colours, upon receipt of the order, needs only select the required components to assemble according to the customers choice. For major clarity the description of the invention continues with reference to the tables in the enclosed drawings, which are intended for purposes of illustration and not in a limiting sense, whereby:

DESCRIPTION OF THE DRAWINGS

FIGS. 4, 5, 6 and 7 are the top, bottom, internal side and external side views respectively of the sole of the sandal according to the invention;

FIG. 4A is an enlarged perspective view of the transverse element.

FIG. 4B is an enlarged perspective view of the truncated-cone element.

DESCRIPTION OF THE PREFERRED EMBODIMENTS

Figure 1:
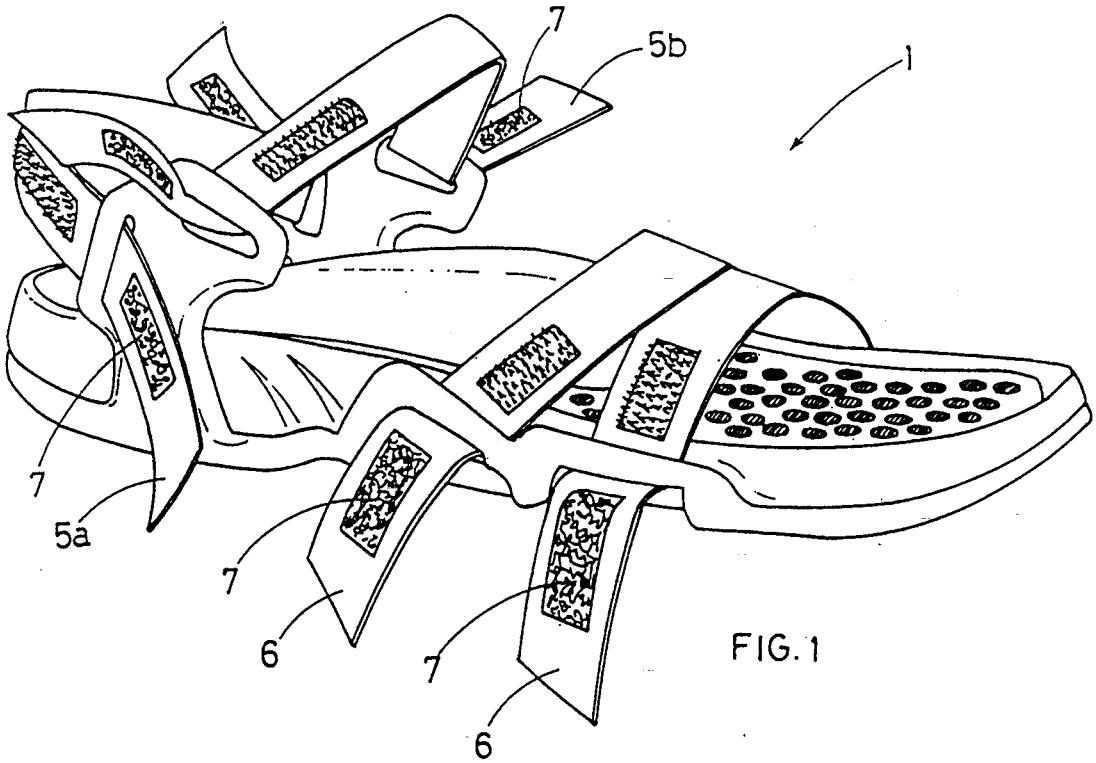
FIGS. 1 and 2 are a perspective view of the sandal according to the invention illustrating the straps fastened and unfastened respectively.
Figure 2:
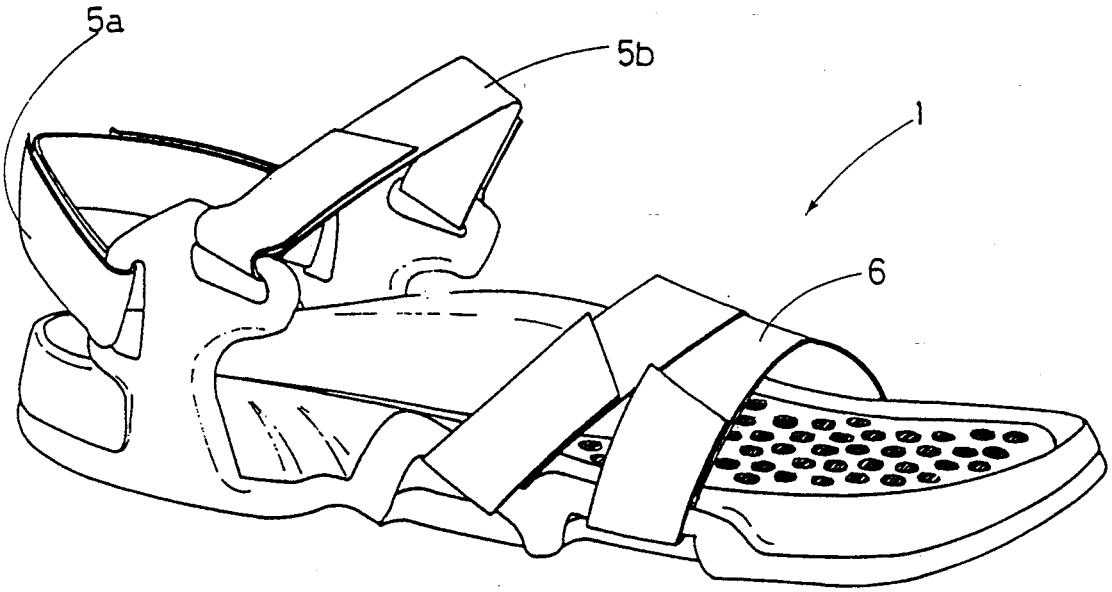

With reference to the above drawings, sandal (1) consists of a multi-layer sectional bottom having side slots through which the straps are threaded and fastened.

Said bottom consists of a sole (2), a mid-sole (3) and an insole (4) all of which are moulded in plastic.

With particular reference to drawings 4–7, the sole (2) is characterized by a series of slots (**2*a*) and cuts (2*b*) which house conforming and corresponding projections (3*a* and 3*b*) on the bottom surface of the mid-sole (3**).

Said sole (2) being characterized by two opposing and identical flaps (**2*c*) which project from the side edges of the sole (2), approximately at the level of the ankle-bones; said flaps (2*c*) terminating at the top with an enlarged head having two cuts, one of which is vertical (2*d*) and the other sub-horizontal (2*e***).

Strap (**5*a*), which holds the back of the ankle, is threaded into the vertical slots (2*d*) while strap (5*b*), which holds the front of the ankle, is threaded into slots (2*e***).

The side edges of the sole (2) being characterized by a number of opposing and projecting ears at the level of the metatarsal area of the foot; two consecutive ears (**2*f*) being on the external side and one ear (2*g***) being on the internal side.

All three ears having an internal slot (**2*h*) for the passage of a strap (6) which is first threaded through one of the two ears (2*f*) and then through the opposite ear (2*g*), and thereafter being folded back and threaded into the third ear (2*f*), adjacent to the first, so that the top of the foot is held by two adjacent transverse straps, both consisting of the same folded strap (6**).

The straps (**5*a*, 5*b* and 6) consist of bands having inserts (7**) of self-adhesive material, which allow rapid fastening and unfastening of the straps as well as regulation of the tension.

The top surface of the sole (2) is characterized by a series of regularly spaced truncated-cone elements (**2*i*) along the perimeter which fit into corresponding dead holes (3*i*) on the bottom surface of the mid-sole (3**).

The base of the internal face of the flaps (**2*c*) and of the ears (2*f* and 2*g*) being characterized by transverse elements (2*m*) which fit into corresponding transverse slots (3*m*) along the edge of the mid-sole (3**).

Figure 3:
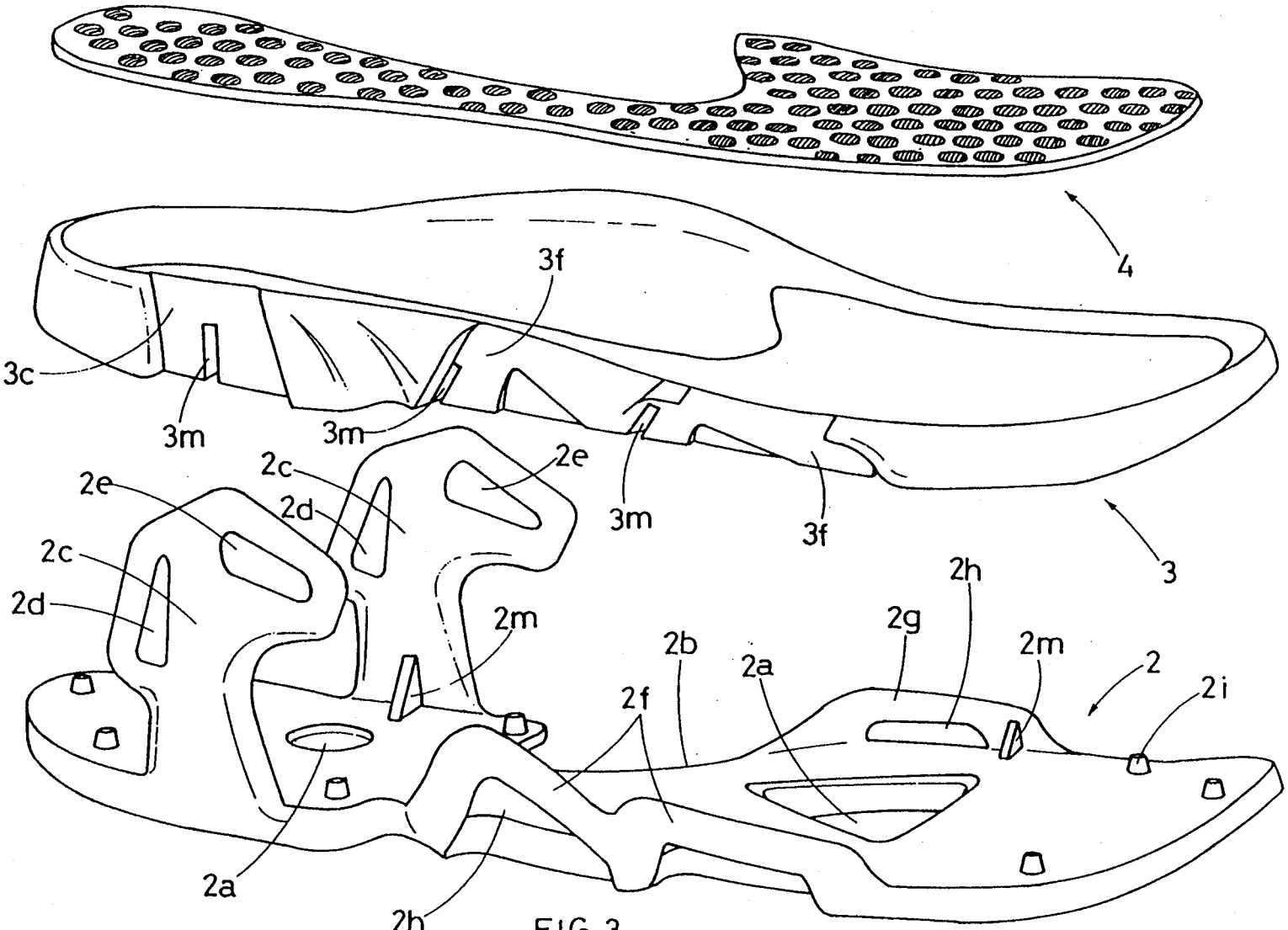
FIG. 3 is a perspective view of the sandal according to the invention without straps, illustrating the three components (sole, mid-sole and insole), spaced one top of the other.
Figure 9:
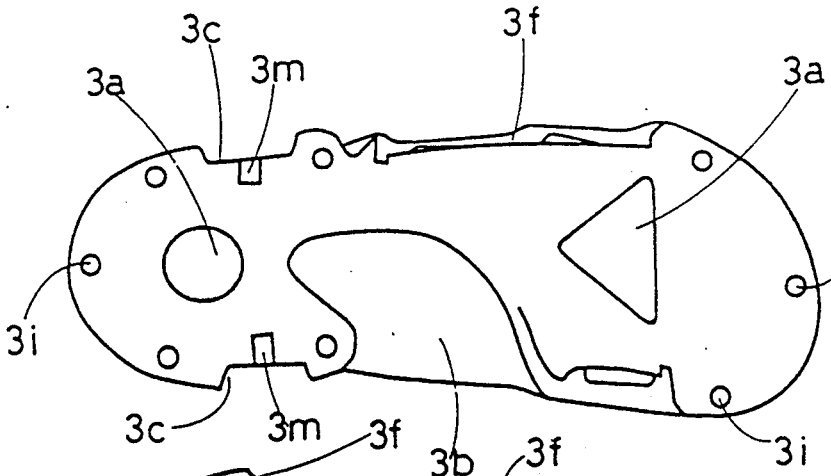
FIGS. 8, 9, 10 and 11 are the top, bottom, internal side and external side view of the mid-sole according to the invention.

With particular reference to FIG. 3 and to FIG. 9, it should be noted that the sides of the mid-sole (3) are characterized by reduced housings (**3*c*) for housing the flaps (2*c*) of the sole (2) as well as reduced housings (3*g* and 3*f*) for housing the ears (2*g* and 2*f*) respectively of the sole (2) so as to avoid having raised sections on the sides of the sandal (1**).

Figure 8:
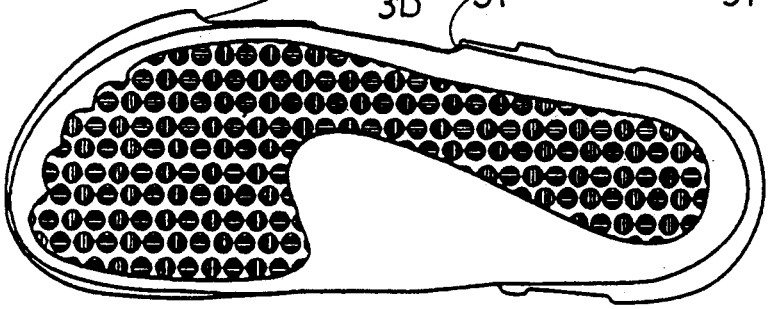
Figure 11:
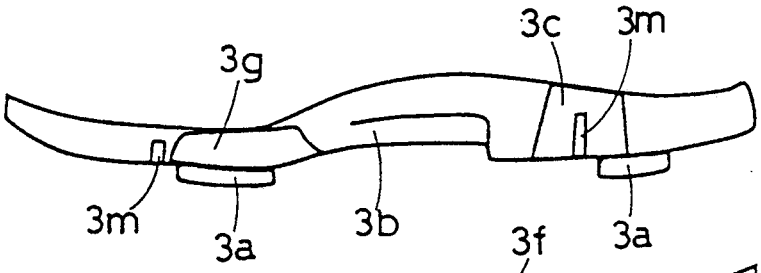
Figure 10:
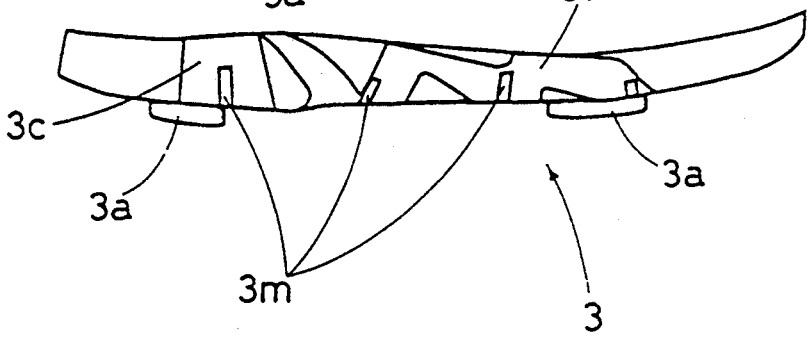

The insole (4) is either glued or wedged onto the mid-sole (3) which has an anatomical shape, as shown in FIGS. 8 and 3.

We claim:

1. A sandal consisting of components assembled without the use of special tooling or skilled labour characterized by:

a moulded plastic sole (2) having a series of slots (2*a*) and cuts (2*b*) for housing conforming and corresponding projections (3*a* and 3*b*) on a bottom surface of a plastic moulded midsole (3); said sole (2) being characterized by two opposing and identical flaps (2*c*) which project from the side edges of this sole (2), approximately at the level of the anklebones; said flaps (2*c*) terminating at the top with an enlarged head having two slots, one of which is vertical (2*d*) and the other sub-horizontal (2*e*); side edges of the sole (2) being characterized by a number of opposing and projecting ears at the level of the metatarsal area of the foot; two consecutive ears (2*f*) being on the lateral side and one ear (2*g*) being on the internal side, all three ears having an internal slot (2*h*); the top surface of the sole (2) being characterized by a series of regularly spaced truncated-cone elements (2*i*) along the perimeter which fit into corresponding dead holes (3*i*) on the bottom surface of the mid-sole (3); a base of the internal face of the flaps (2*c*) and of the ears (2*f* and 2*g*) being characterized by transverse elements (2*m*) which fit into corresponding transverse slots (3*m*) along the edge of the mid-sole (3);

the sides of the mid-sole (3) having reduced housings (3*c*) for housing the flaps (2*c*) of the sole (2) as well as reduced housings (3*g* and 3*f*) for housing the ears (2*g* and 2*f*) of the sole (2), respectively;

an insole (4) fitted above the mid-sole (3) having a close-fitting series of non-slip projections;

a set of three straps (5*a*, 5*b* and 6) each having fastening and hooking devices: the first (5*a*) holding the ankle, the second (5*b*) holding the front of the foot, the third being a double strap (6) which is folded back to hold the top of the foot at the level of the metatarsal area of the foot.

2. A sandal consisting of components assembled without the use of special tooling or skilled labour according to claim 1 characterized in that the fastening and hooking means of the straps (5*a*, 5*b* and 6) in the preferred embodiment of the invention consist of inserts (7) made of self-adhesive material.

* * * * *